US011414240B2

(12) United States Patent
Steeves

(10) Patent No.: US 11,414,240 B2
(45) Date of Patent: Aug. 16, 2022

(54) DEBRIS BARREL

(71) Applicant: Jonathan Steeves, Milford, CT (US)

(72) Inventor: Jonathan Steeves, Milford, CT (US)

( * ) Notice: Subject to any disclaimer, the term of this patent is extended or adjusted under 35 U.S.C. 154(b) by 0 days.

(21) Appl. No.: 16/910,203

(22) Filed: Jun. 24, 2020

(65) Prior Publication Data

US 2020/0399024 A1 Dec. 24, 2020

Related U.S. Application Data

(60) Provisional application No. 62/970,749, filed on Feb. 6, 2020, provisional application No. 62/865,501, filed on Jun. 24, 2019.

(51) Int. Cl.
*B65D 25/20* (2006.01)
*B65D 25/38* (2006.01)
*B65D 25/30* (2006.01)

(52) U.S. Cl.
CPC ..... *B65D 25/38* (2013.01); *B65D 25/20* (2013.01); *B65D 25/30* (2013.01)

(58) Field of Classification Search
CPC ..... B65D 15/00; B65D 25/20; B65D 25/24; B65F 1/141; B65F 1/125; B65F 1/1468; B65F 2230/00
See application file for complete search history.

(56) References Cited

U.S. PATENT DOCUMENTS 1,212,305 A * 1/1917 Worsen ..... B62B 1/208 294/178
2,192,424 A * 3/1940 Wilson ..... B65D 3/10 493/103

(Continued)

FOREIGN PATENT DOCUMENTS

JP 3116035 U 10/2005

*Primary Examiner* — Andrew T Kirsch
(74) *Attorney, Agent, or Firm* — Michael A. Blake

(57) ABSTRACT

A debris barrel comprising: a bottom of the barrel, where the bottom of the barrel has a circular shape, such that the barrel can be rolled about its bottom; a barrel wall extending from the bottom, the barrel wall and bottom forming a container; a top of the barrel located at the top of the barrel wall, where the top of the barrel comprises a first side, a second side, a third side, and a fourth side, where the first side is parallel to the third side, the second side is parallel to the fourth side, the first side is orthogonal to the second side and fourth side, the second side is orthogonal to the third side, and the third side is orthogonal to the fourth side; a bottom cap removeably attached to the bottom of the barrel and a portion of the barrel wall; and a handle means located near the top of the barrel. A barrel bottom cap configured to attach to a bottom of a barrel and a portion of a barrel wall, the bottom cap comprising: a generally planar circular surface, the generally planar circular surface having an outer perimeter; a circular opening located in the center of the generally planar circular surface; a circular wall extending upward from the outer perimeter of the circular surface, the circular wall generally at an obtuse to right angle with the circular surface; a first catch member extending upward from the circular wall, the first catch member comprising: a first catch orifice, where the first catch orifice is configured to lock with a first tongue member located on an outer surface of a barrel wall when the barrel bottom cap is slid onto the bottom of the barrel.

20 Claims, 10 Drawing Sheets

(56) References Cited

U.S. PATENT DOCUMENTS

| | | | | |
|---|---|---|---|---|
| 4,167,271 | A * | 9/1979 | Jorgensen | B65F 1/1468 280/79.5 |
| 5,110,000 | A | 5/1992 | Nichols | |
| 5,285,996 | A * | 2/1994 | Waller | B65D 25/24 248/346.11 |
| 5,531,351 | A * | 7/1996 | Logsdon | B67C 11/02 220/203.11 |
| 6,971,540 | B1 | 12/2005 | Przytulla | |
| 7,318,247 | B2 | 1/2008 | Libman | |
| 7,325,968 | B2 | 2/2008 | Huckby | |
| 7,370,770 | B2 | 5/2008 | Chomik | |
| 8,757,424 | B1 * | 6/2014 | Chesser | B44D 3/12 220/669 |
| 9,561,880 | B2 | 2/2017 | Luburic | |
| 2002/0003144 | A1 * | 1/2002 | Grimes | B65F 1/068 220/625 |

* cited by examiner

DEBRIS BARREL

CROSS-REFERENCES

This patent application claims priority to provisional patent application No. 62/865,501 filed on Jun. 24, 2019, by Jonathan Steeves and Jenna Steeves, and titled: "DEBRIS BARREL" which provisional application is fully incorporated by reference herein. This patent application also claims priority to provisional patent application No. 62/970,749 filed on Feb. 6, 2020, by Jonathan Steeves, and titled: "DEBRIS BARREL" which provisional application is fully incorporated by reference herein.

TECHNICAL FIELD

The present invention relates to an improvement to debris barrels, and more particularly a debris barrel that has a rounded bottom and a top with generally a square shape and a removable bottom cap.

BACKGROUND

Landscape, construction, cleaning and other commercial and industrial companies, and/or homeowners often use large plastic "debris barrels" to store, carry, and/or transport, debris and/or work material when working at a job site. Known debris barrels have many disadvantages. For example, the majority of existing debris barrels have a round and/or rounded top. When a user wishes to load known debris barrels, they often lay the debris barrel on its side and move the debris into the debris barrel using a rake, broom, shovel, etc. The round top of known debris barrels does not lay flat and/or flush with the ground, thus the barrel is prone to rolling and/or moving, and a large amount of debris material intended for the debris barrel is lost where the debris barrel edges do not meet and/or touch the ground. This disadvantage is amplified if multiple known round-topped debris barrels are laid side by side. Another disadvantage of known debris barrels is that they often have thick top edges that, when the debris barrel is laid on its side, create a raised surface that makes it difficult for the user to efficiently and effectively get all the desired debris into the debris barrel by sweeping, raking, shoveling, etc. Another disadvantage of known debris barrels is that, because they are often filled with of heavy material, and are often dragged along the ground because of their poor design, the bottom of the debris barrel often wears out quickly, creating a hole in the bottom of the debris barrel, and making the debris barrel useless. Another disadvantage of known debris barrels is they typically have only one metal handle attached to the debris barrel, and that one metal handle often will quickly break off from the barrel. The metal handle is also painful to hold. Additionally, with only one handle, generally only one worker can use the handle to move the barrel. Thus, when a barrel is filled with heavy material, it is difficult for one worker to move the barrel using the one handle.

Thus there is a need for a debris barrel that overcomes the above listed and other disadvantages.

SUMMARY OF THE INVENTION

The invention relates to a debris barrel, the debris barrel comprising: a bottom of the barrel, where the bottom of the barrel has a circular shape, such that the barrel can be rolled about its bottom; a barrel wall extending from the bottom, the barrel wall and bottom forming a container; a top of the barrel located at the top of the barrel wall, where the top of the barrel comprises a first side, a second side, a third side, and a fourth side, where the first side is parallel to the third side, the second side is parallel to the fourth side, the first side is orthogonal to the second side and fourth side, the second side is orthogonal to the third side, and the third side is orthogonal to the fourth side; a bottom cap removeably attached to the bottom of the barrel and a portion of the barrel wall; and a handle means located near the top of the barrel.

The invention also relates to a barrel bottom cap configured to attach to a bottom of a barrel and a portion of a barrel wall, the bottom cap comprising: a generally planar circular surface, the generally planar circular surface having an outer perimeter; a circular opening located in the center of the generally planar circular surface; a circular wall extending upward from the outer perimeter of the circular surface, the circular wall generally at an obtuse to right angle with the circular surface; a first catch member extending upward from the circular wall, the first catch member comprising: a first catch orifice, where the first catch orifice is configured to lock with a first tongue member located on an outer surface of a barrel wall when the barrel bottom cap is slid onto the bottom of the barrel.

BRIEF DESCRIPTION OF THE DRAWINGS

The present disclosure will be better understood by those skilled in the pertinent art by referencing the accompanying drawings, where like elements are numbered alike in the several figures, in which.

DETAILED DESCRIPTION OF THE INVENTION

Figure 1:
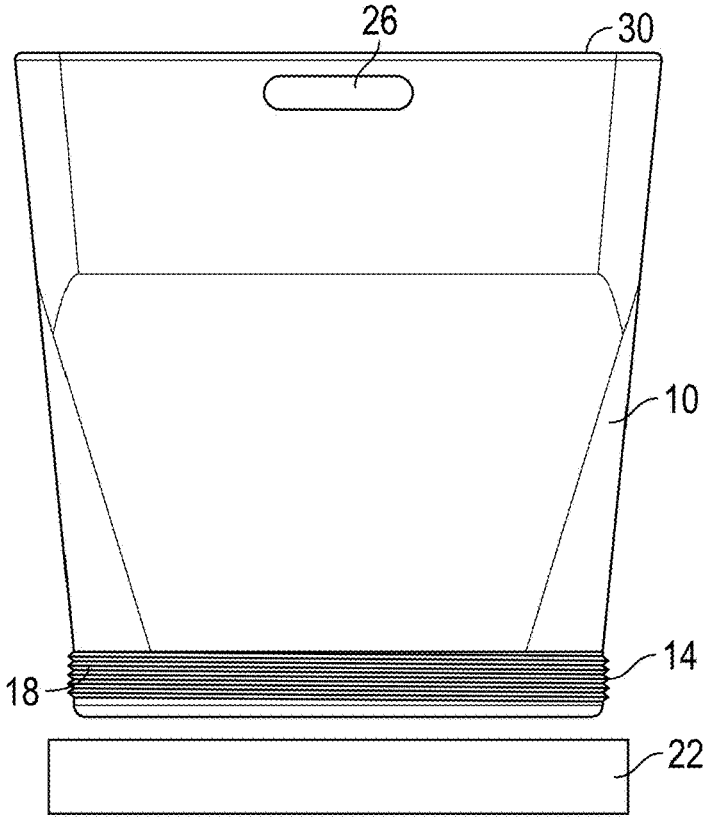
FIG. 1 is a front view of the debris barrel.

FIG. 1 is a front view of the disclosed barrel 10. The barrel 10 has a generally circular bottom 14 that may have threads 18 on its outer surface. A removable and replaceable barrel bottom cap 22 has threads on its inner surface, which threads mate with the threads 18. The barrel 10 has integral handles 26 built in to the barrel 10 near the top 30 of the barrel. The barrel 10 tapers down from the top 30 to the bottom 14. This will allow the barrel 10 to be stackable. The integral handles may be orifices sized to fit four fingers of a hand, and may have a top portion of the orifice curved back on itself to provide a greater area for the fingers to abut against when carrying the barrel.

Figure 2:
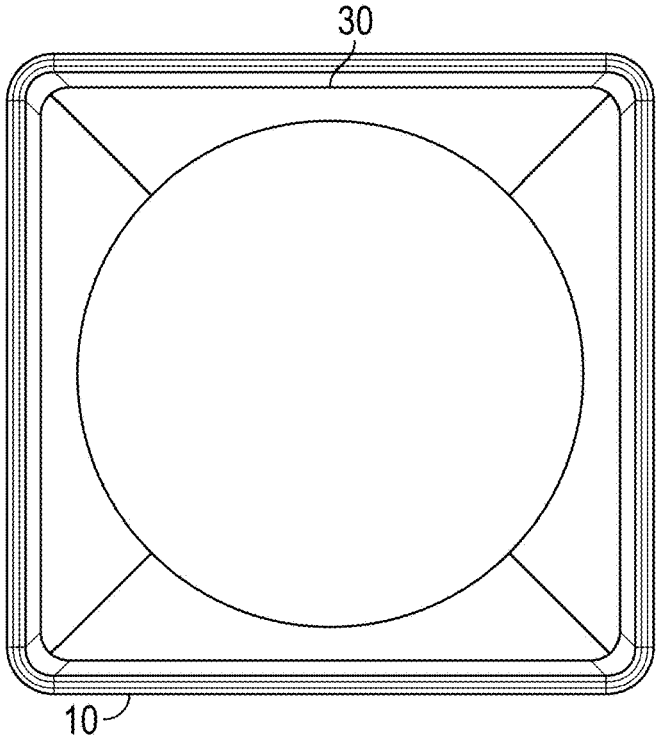
FIG. 2 is a top view of the debris barrel.

FIG. 2 is a top view of the barrel 10. The top 30 of the barrel has a square shape. Having a square top instead of a circular top, allows raking/sweeping/shoveling items into the barrel to be much more efficient. In one embodiment, the entire edge of the barrel may be flush with/flat on the surface, yielding less wasted effort, and less lost material.

Figure 3:
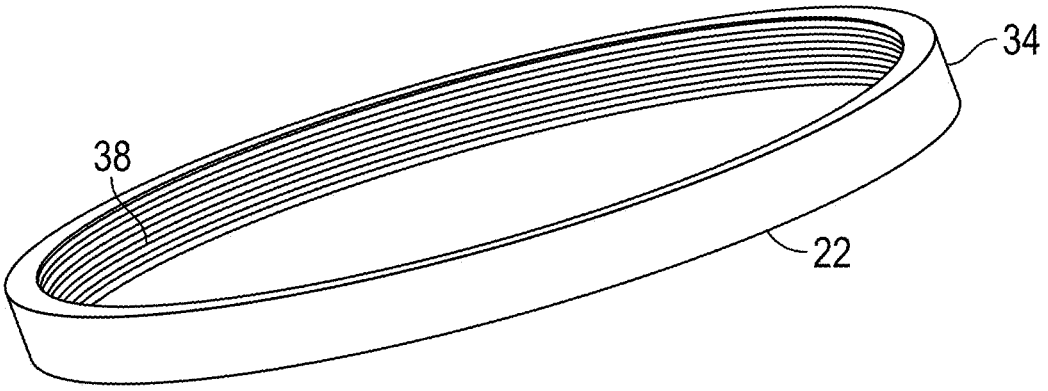
FIG. 3 is a perspective view of the bottom cap.

FIG. 3 is a perspective view of the bottom cap 22. The bottom cap 22 is generally circular because it fits over the circular bottom 14 of the barrel. The bottom cap 22 comprises a sidewall 34. The inner surface of the sidewall 34 has threads 38 that mate with the threads 18. The bottom cap 22 protects the bottom of the barrel 10. If the bottom cap 22 wears out, it can be easily replaced with a new bottom cap 22.

Figure 4:
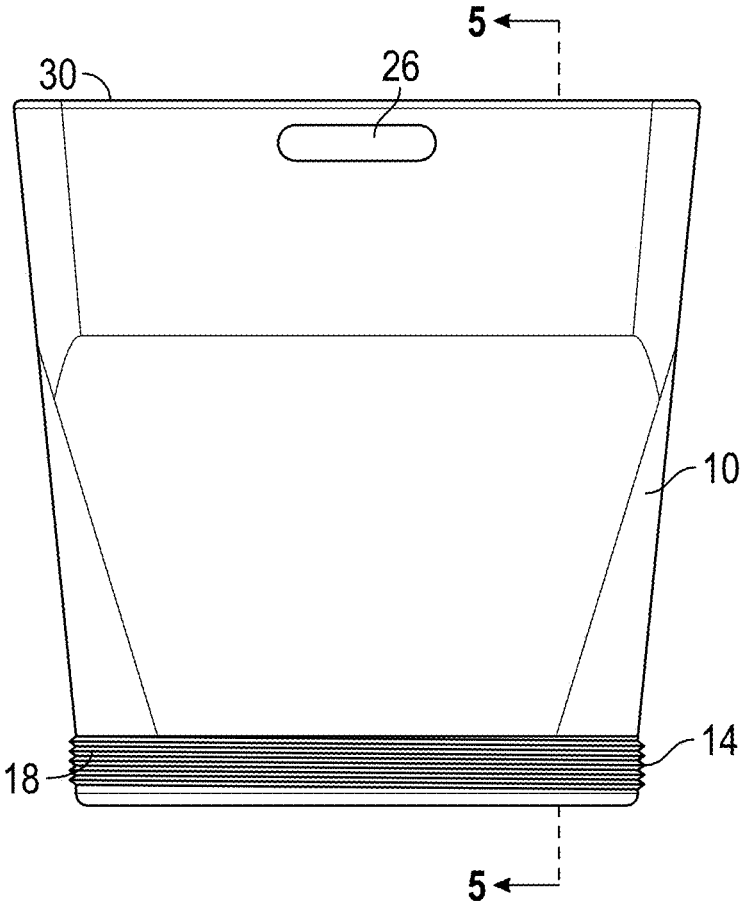
FIG. 4 is a front view of the debris barrel.

FIG. 4 is a front view of just the debris barrel 10 without the bottom cap 22.

Figure 5:
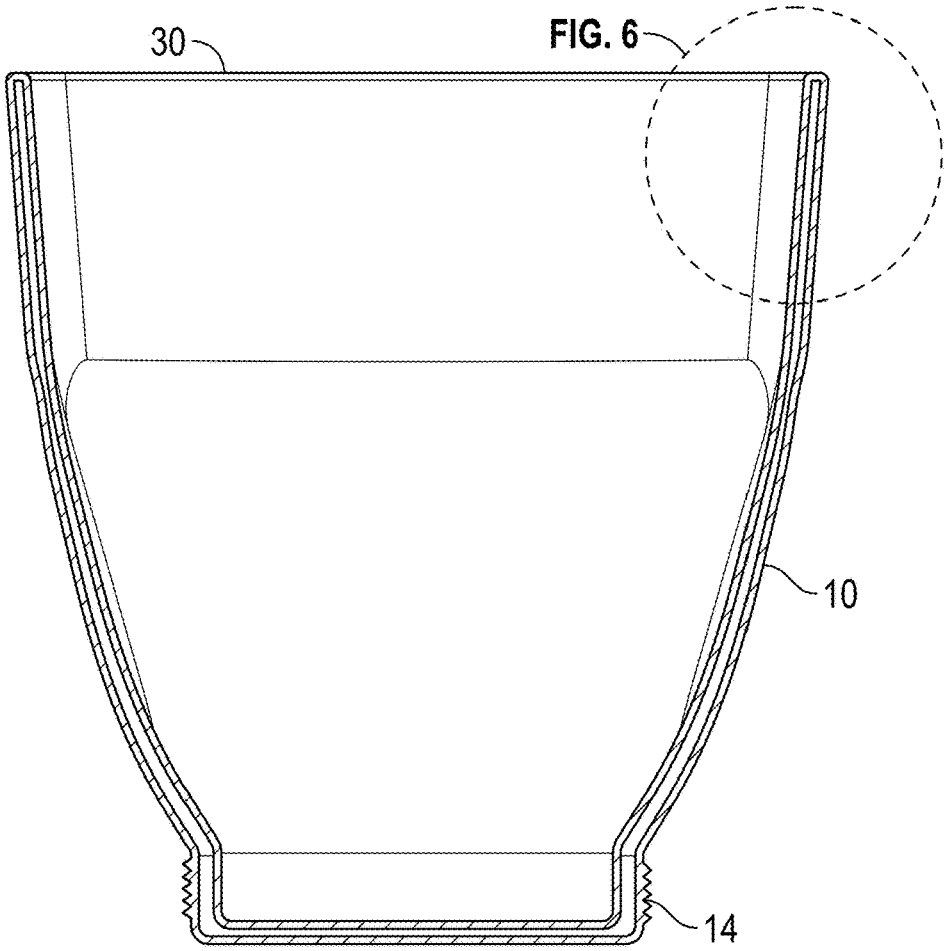
FIG. 5 is a sectional view of the debris barrel.

FIG. 5 is a sectional view of the debris barrel 10 through the section A-A from FIG. 4.

Figure 6:
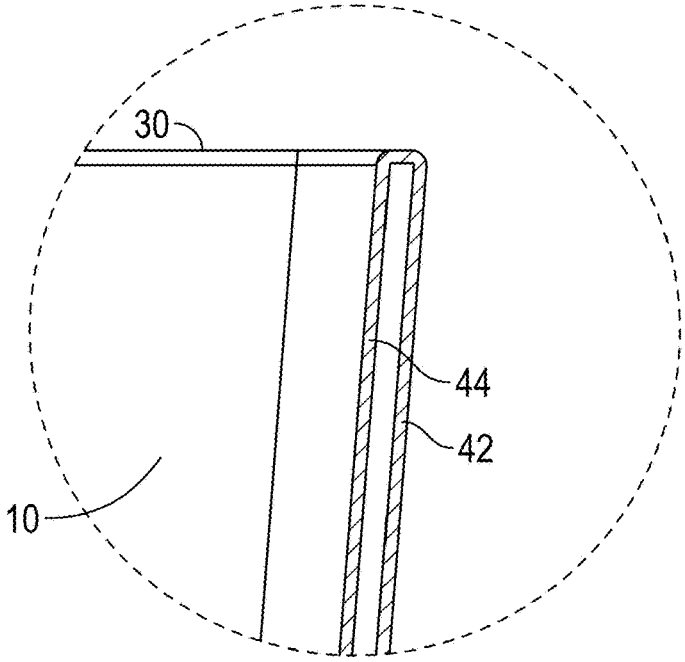
FIG. 6 is a detail view of the debris barrel.

FIG. 6 is a detail view from FIG. 5. In this view, it can be seen that the barrel 10 may have double walls 42, 44.

In another embodiment, both the barrel 10 and barrel bottom cap 22 may be threadless, and the bottom cap 22 may removeably snap on to the barrel 10, or may removeably attach to the barrel via an interference fit. In still another embodiment, both the barrel 10 and barrel bottom cap 22 may be threadless, and the barrel 10 may have catches, and the bottom cap 22 may latch on to the catches, so the bottom cap 22 is removeably attachable to the barrel 10. In still another embodiment, the bottom cap 22 may have the catches, and the barrel 10 removeably latches on to the bottom cap 22.

Figure 7:
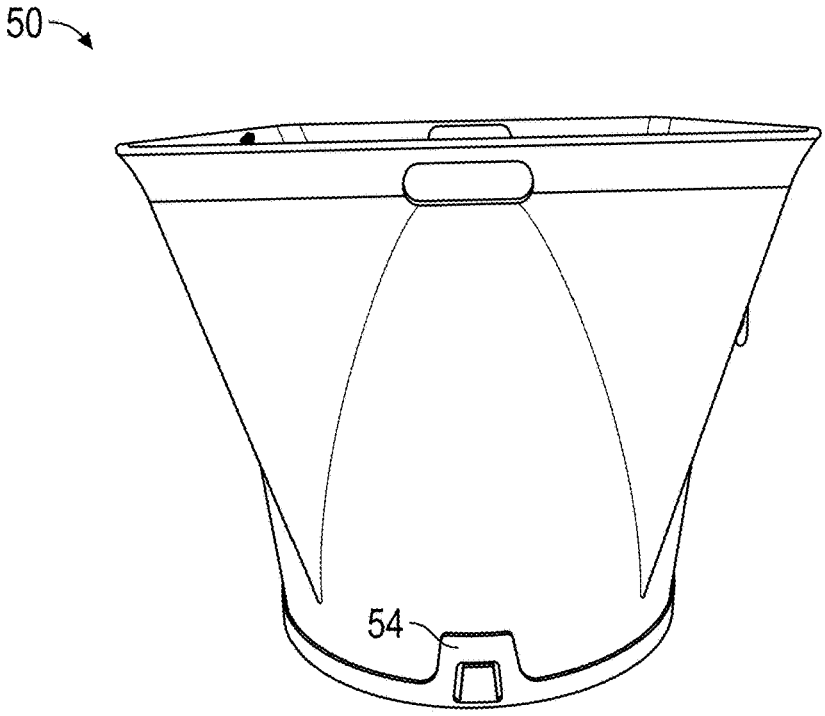
FIG. 7 is a front perspective view of an embodiment of the barrel with a snap on bottom cap.

FIG. 7 shows a front perspective view of an embodiment of the barrel 50, with a snap on bottom cap 54. In one embodiment, the barrel may have the following the dimensions: each side of the square top may be about 28.5", the round bottom is about 24 inches in diameter, the barrel height may be about 30 inches tall, and the barrel may hold a volume of about 65 gallons. Of course, one of ordinary skill in the art will recognize that the debris barrel may come in many different sizes.

Figure 8:
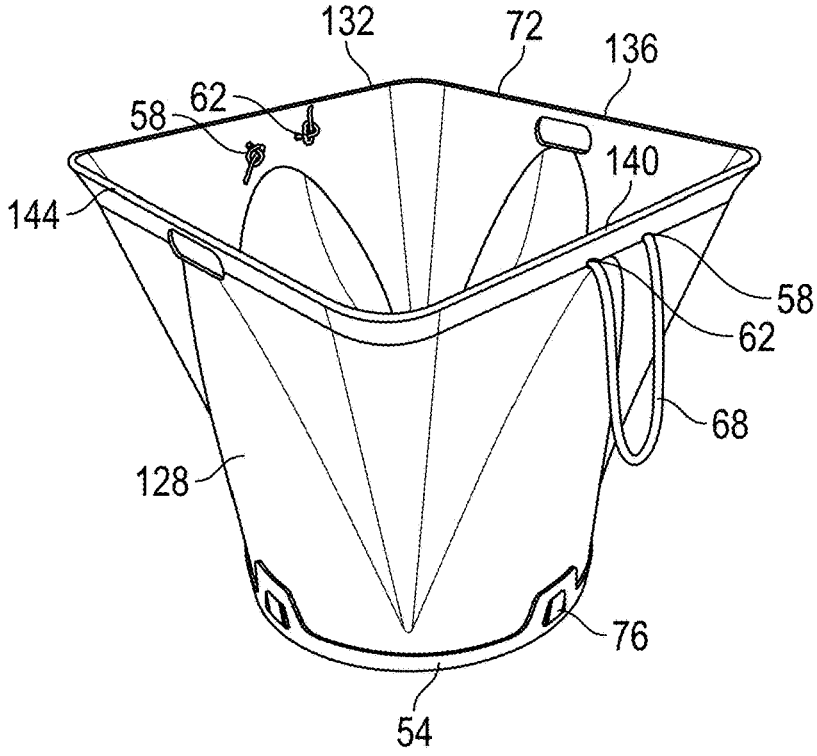
FIG. 8 is another front perspective view of the barrel from FIG. 7.

FIG. 8 is another front perspective view of the barrel 50 from FIG. 7. In this view it can be seen that in this embodiment, the barrel does not have handle cut outs that can fit a hand, but rather has at least one set of two holes 58, 62 configured to hold a rope handle 68. One of ordinary skill in the art will recognize that the rope handle 68 may comprise a variety of handle types and materials, such as nylon handle, a loop, a braided rope, a loop with a plastic handle piece, etc. The barrel 50 comprises a barrel wall 128 located between the top of the barrel 72 and the bottom of the barrel 76. The square top 72 comprises a first side 132, a second side 136, a third side 140, and a fourth side 144. Because the barrel 50 has a square top, the first side 132 is parallel to the third side 140, the second side 136 is parallel to the fourth side 144, the first side 132 is orthogonal to the second side 136 and fourth side 144, the second side 136 is orthogonal to the third side 140, and the third side 140 is orthogonal to the fourth side 144.

Figure 9:
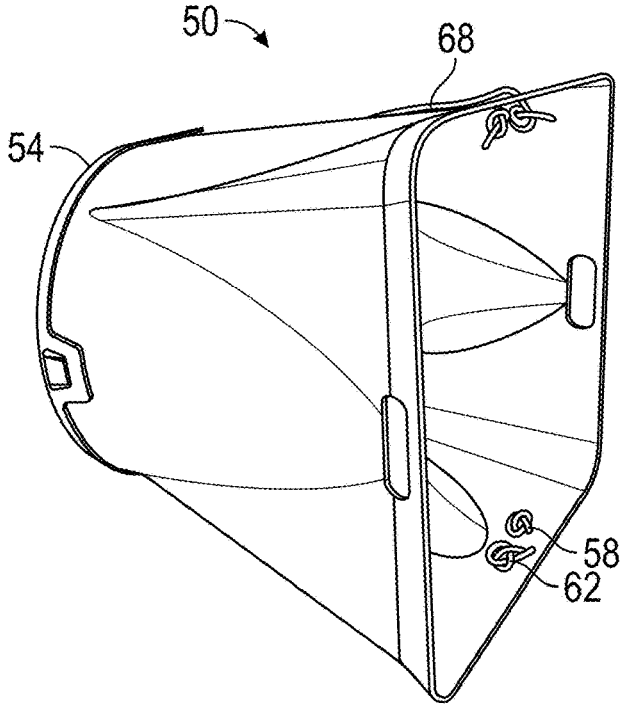
FIG. 9 is a perspective view of the barrel from FIG. 7 on its side.

FIG. 9 is a perspective view of the barrel 50 on its side.

Figure 10:
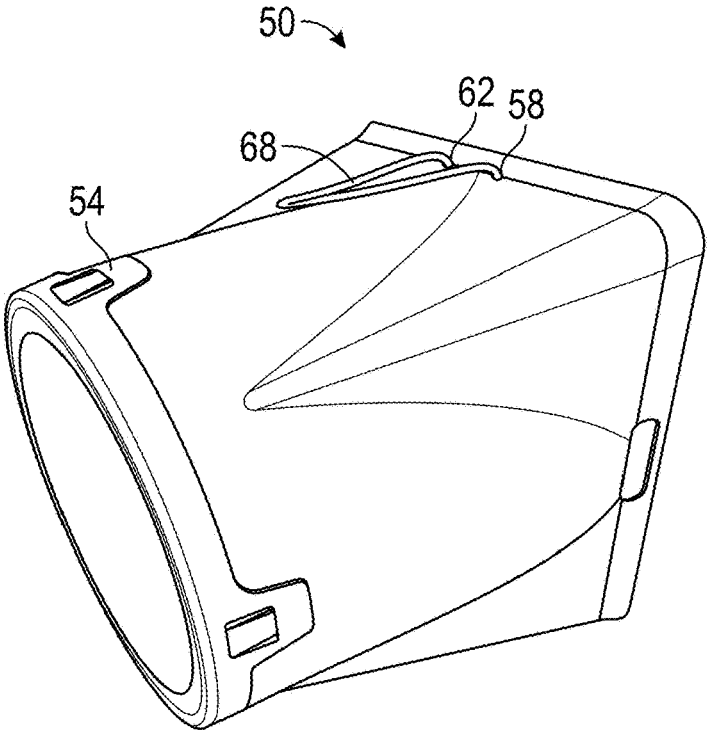
FIG. 10 is another perspective view of the barrel from FIG. 7 on its side.

FIG. 10 is another perspective view of the barrel 50 on its side.

Figure 11:
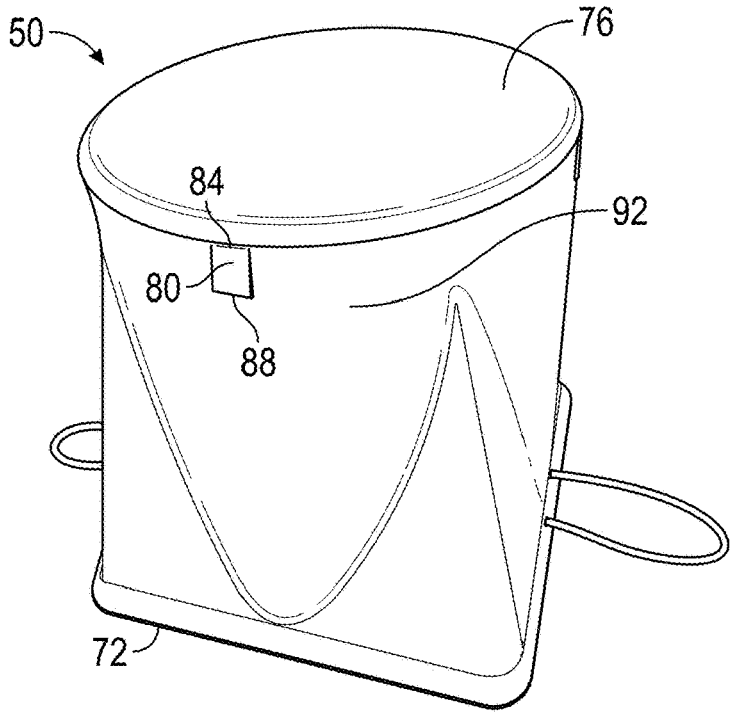
FIG. 11 is a view of the barrel from FIG. 7 resting on its square top.

FIG. 11 is a view of the barrel 50 resting on its square top 72. The circular bottom 76 of the barrel 50 is facing upward. The bottom cap 54 has been removed. At least one tongue 80 is shown near the bottom 76. The tongue 80 may be generally rectangular shape, and has a bottom end 84, and a top end 88. The bottom end 84 of the tongue 80 is about flush with the outer surface 92 of the barrel 50. The top end 88 of the tongue 80 extends out and away from the outer surface 92 of the barrel 50. The tongue 80 may taper from the top end 88 down to where it is flush or about flush with the outer surface 92 of the barrel at the bottom end 84. The amount the top end 88 extends away from the outer surface of the barrel 50 may range from about 1/16 of an inch to about ½ of an inch.

Figure 12:
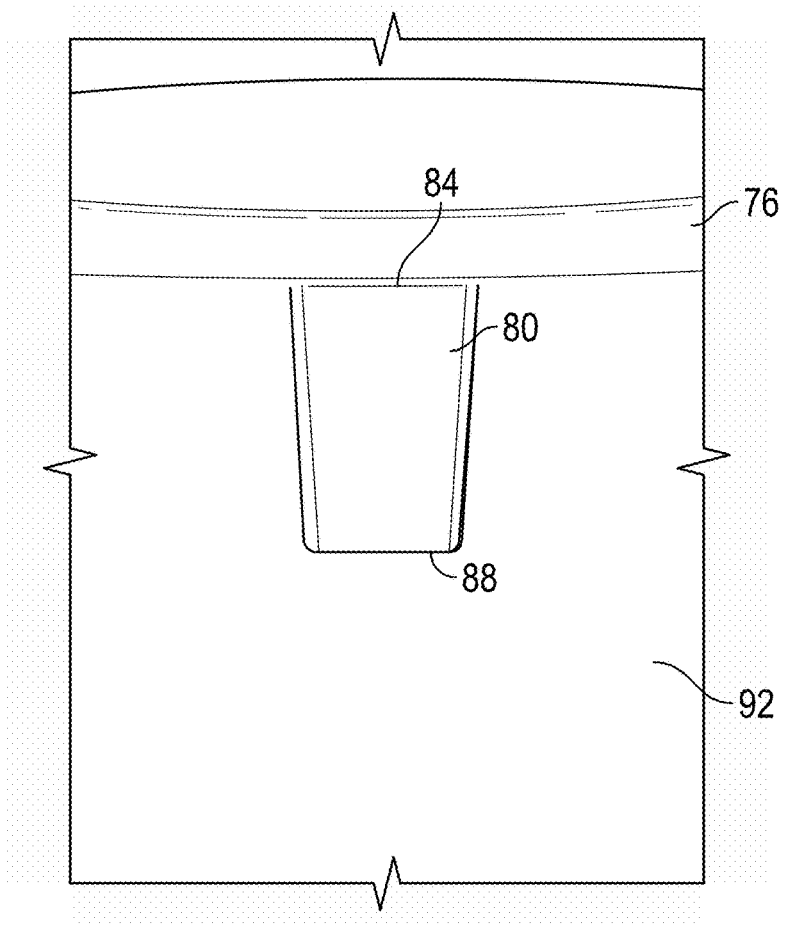
FIG. 12 is a close up drawing of the tongue.

FIG. 12 is a close up view of the tongue 80.

Figure 13:
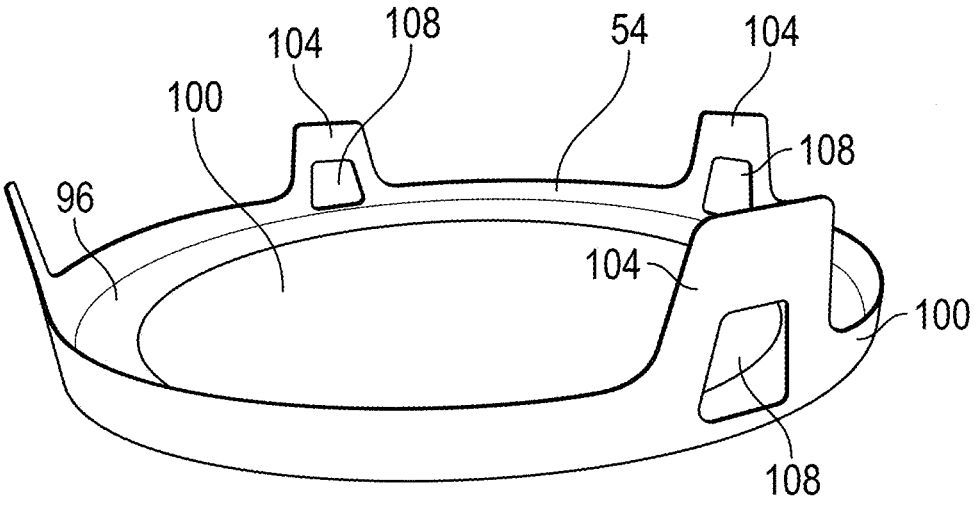
FIG. 13 is a perspective view of the snap on bottom cap.

FIG. 13 is a perspective view of the snap on bottom cap 54. The cap 54 comprises a generally planar circular surface 96. Within the circular surface 96 may be a circular opening 100. Extending upward from the outer perimeter of the circular surface 96 is a circular wall 100 that is generally at an obtuse to right angle with the circular surface 96. Extending upward from the wall 100 is at least one catch member 104. Each catch member 104 comprises a catch orifice 108. The catch orifice 108 is configured to lock with the tongue 80 of the barrel 50, when the cap 54 is slid onto the bottom 76 of the barrel 50. As the cap 54 slides onto the bottom 76, the catch members 104 may elastically deform as they slide over the tongue 80, until catch orifice 108 locks with respect to the top end 88 of the tongue 80.

Figure 14:
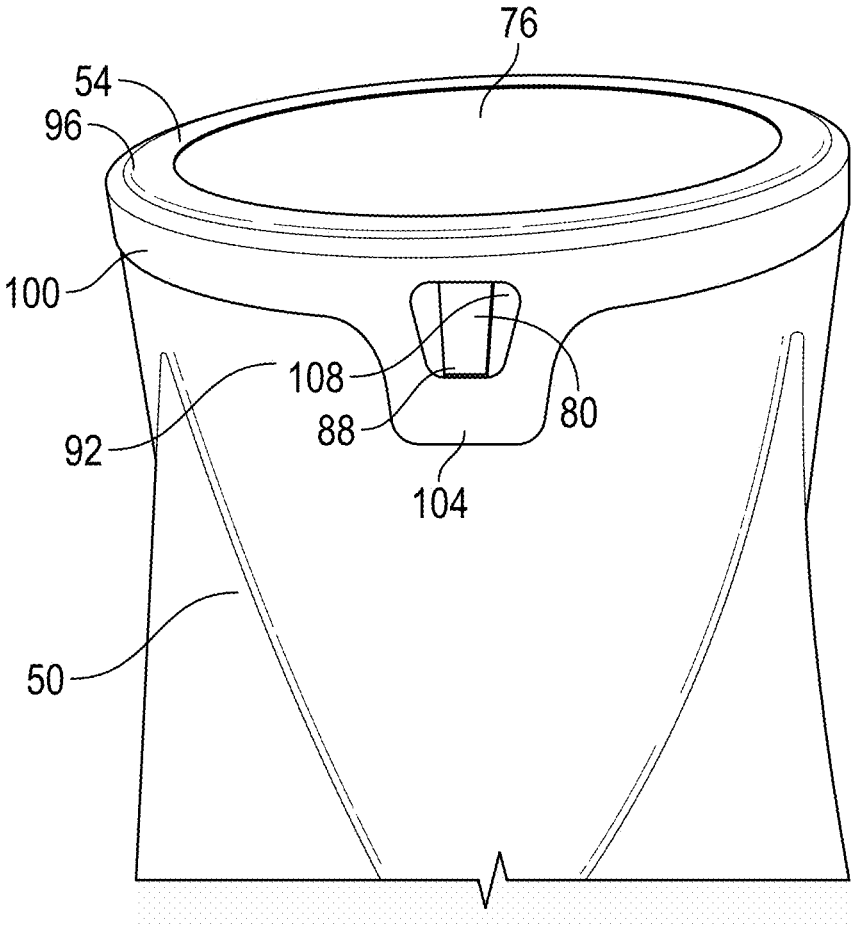
FIG. 14 shows a close up drawing of the cap installed on the bottom of the barrel.

FIG. 14 shows a close up of the cap 54 installed on the bottom 76 of the barrel 50. The top end 88 of the tongue 80 extends out from the outer surface 92 of the barrel 50 and out of the catch orifice 108, thereby preventing the cap 54 from sliding off the barrel 50.

Figure 15:
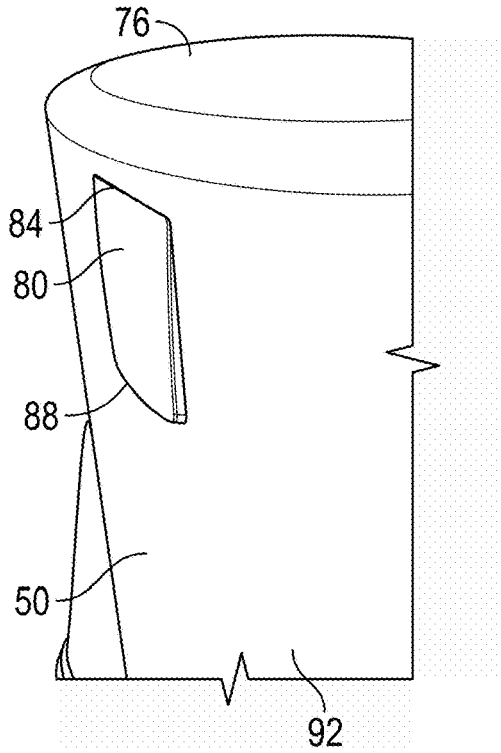
FIG. 15 is another close up drawing of the tongue.

FIG. 15 shows another close up view of the tongue 80.

Figure 16:
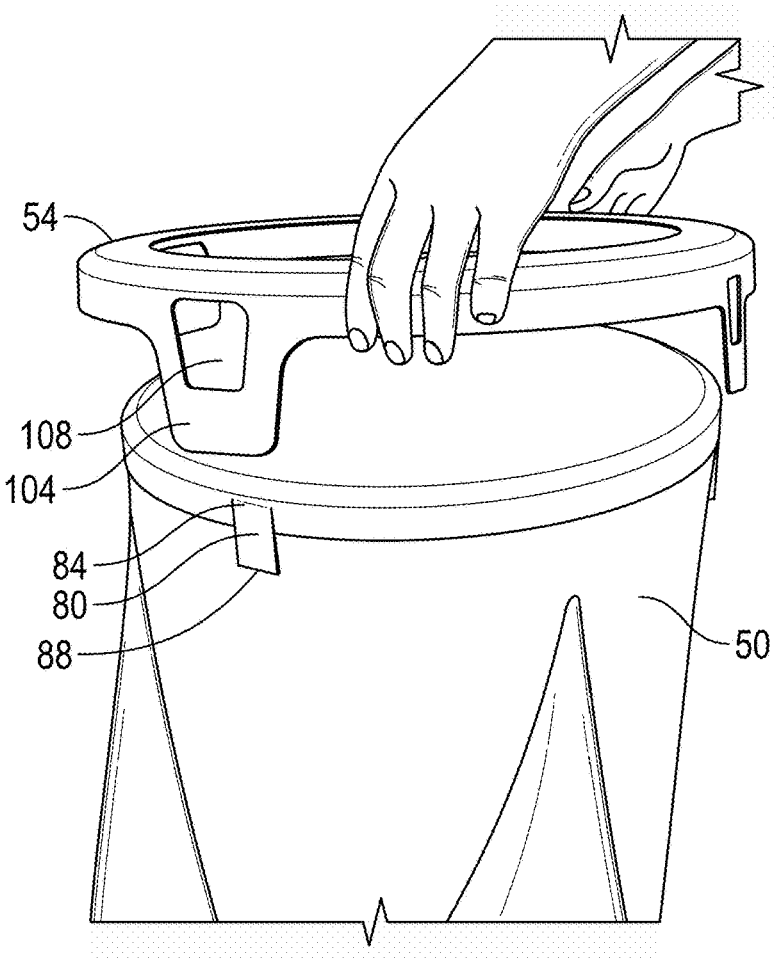
FIG. 16 is a view of the cap being installed on the barrel.

FIG. 16 shows the cap 54 being installed on the barrel 112.

Figure 17:
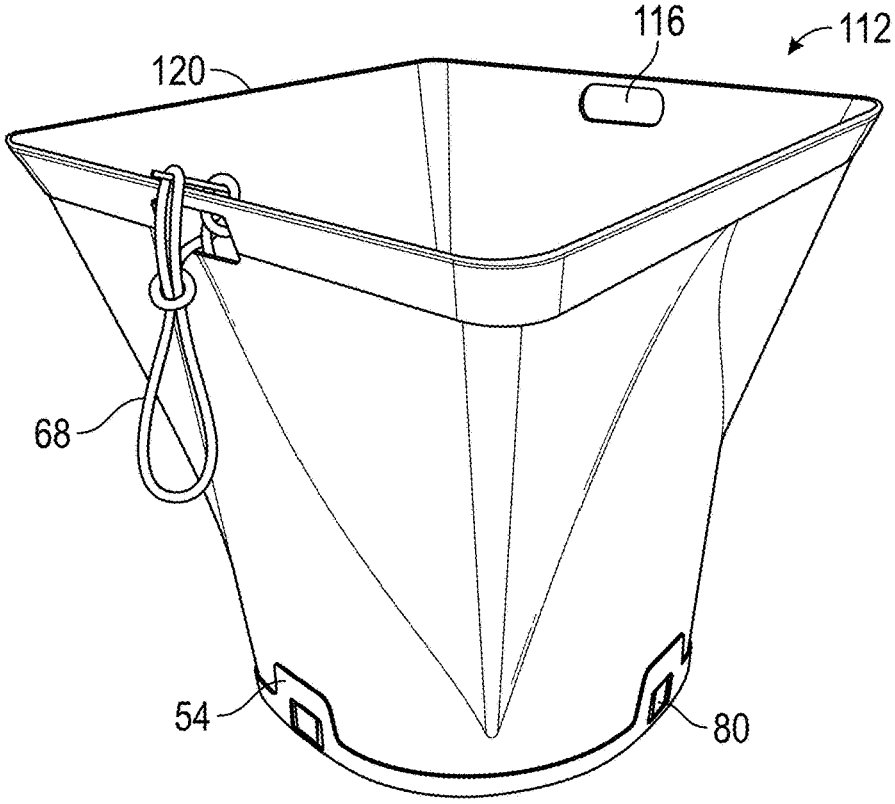
FIG. 17 shows another embodiment of the barrel.

FIG. 17 shows another embodiment of the barrel 112. In this embodiment, there are handholds 116 cut or manufactured into the top 120 of the barrel 112. The handholds 116 may be used as a place to hold the barrel 112, or a rope handle 68 may be attached to the handhold 116 and/or barrel 112

Figure 18:
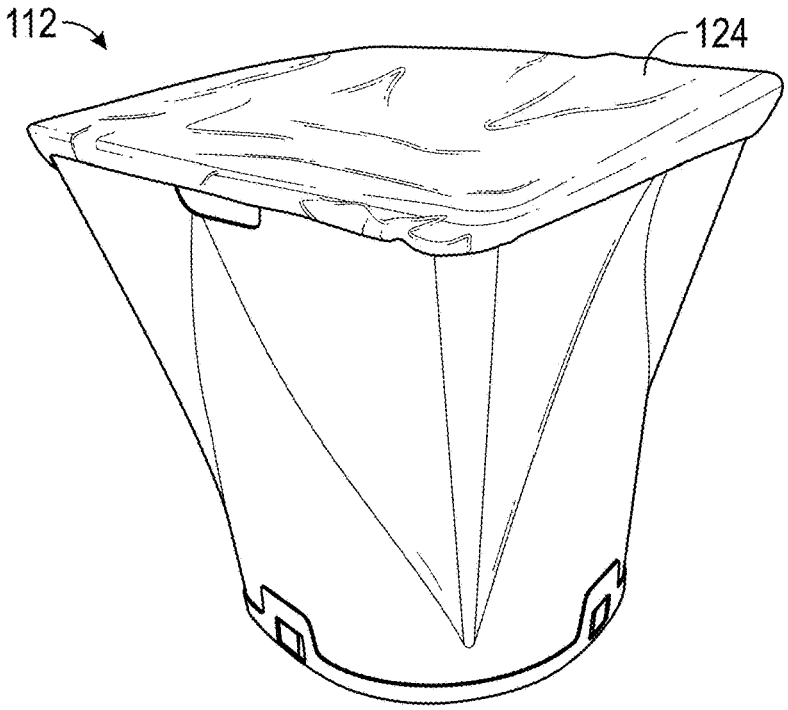
FIG. 18 shows an optional lid for the barrel from FIG. 17.

FIG. 18 shows an optional lid 124 for the barrel 112. The lid may snap onto the top 120 of the barrel 112, or may have a slight interference fit with the barrel 112, or may be attached to the barrel 112 by one or more hinges.

Figure 19:
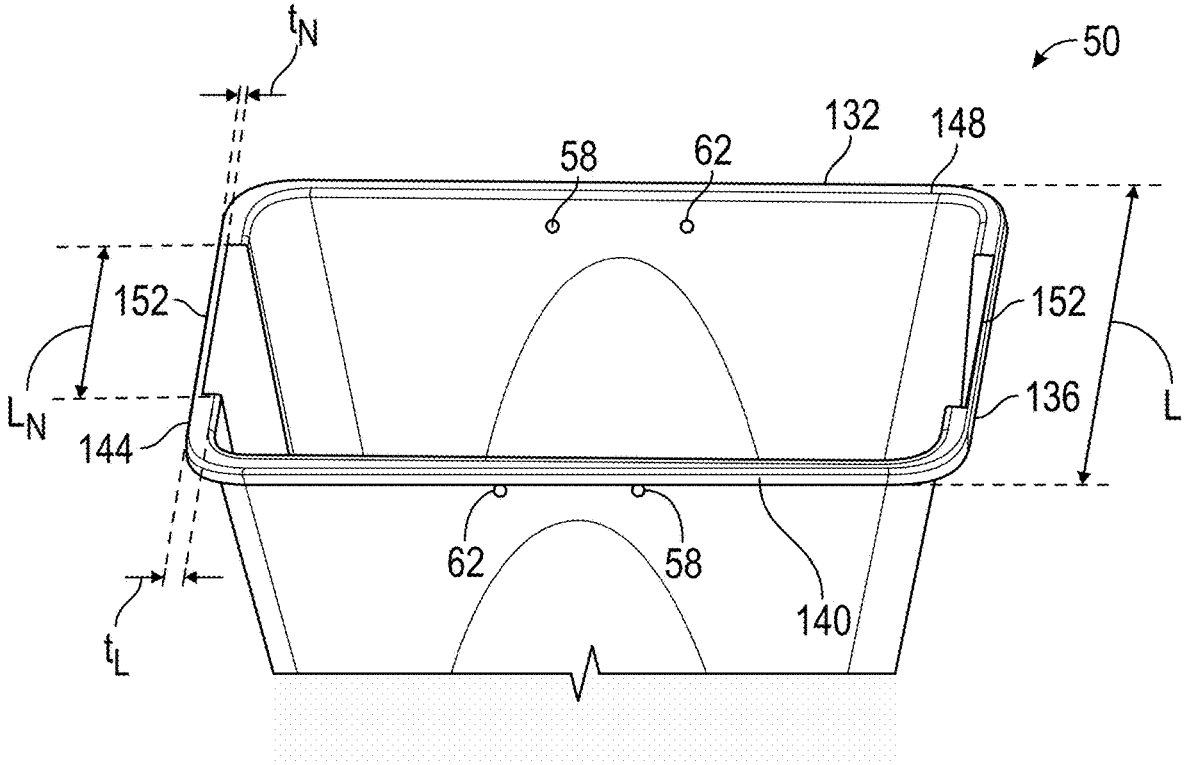
FIG. 19 shows another embodiment of the debris barrel.

FIG. 19 is a perspective view of the top of a debris barrel. In this embodiment the barrel may have a top lip 148 that is located at the top perimeter of the barrel 50. The top lip 148 has a generally uniform thickness $t_L$ of about 0.98 inches to about 1.18 inches. However, the top lip 148 may have one or more narrowed lip sections 152. The narrowed lip section may have a thickness $t_N$ of about 0.59 inches to about 0.787 inches. This narrowed lip section, allows for easier sweeping of material into the barrel 50 when the barrel is laid on one of its sides 1436, 140. The narrowed lip section may have a length $L_N$ of about 15 to 20 inches, where the sides have a length L of about 28½ inches.

In another embodiment, the entire top lip 148 may have a uniform thickness $t_L$ of about 0.59 inches to about 0.787 inches. Thus in this embodiment, the entire top lip 148 has a narrow lip, and there is no need for a portion of the top lip to be even narrower. Thus, sweeping debris into the barrel will generally unencumbered because the entire lip 148 is narrowed. Of course, other dimensions may be used.

The disclosed debris barrel has many advantages. Having a square top instead of a round/circular one allows raking/sweeping/shoveling items into the barrel to be much more efficient because it will take fewer attempts to get the desired debris into the barrel. The square top to round bottom design increases stability and efficiency when picking up piles, as the entire barrel lays flat while on its side allowing more material to be raked or swept in and will not roll away. When the debris barrel is upright its square top-to round bottom design creates a wider, more open, and easier to use funnel when filling the barrel with debris. Two debris barrels abutting each other side by side would not have any gaps (due to the square shape of the tops), so that debris can be dumped from a loader bucket or out of a truck bed into two or more debris barrels abutting each other, and all or most of the debris will end up in the barrels, whereas with circular barrels, there will be gaps between abutting circular barrels and thus greater material loss. The square top also allows for a flush fit in corners or pushed up to the back of a truck. The barrel will have a significantly increased lifespan by having a removable and replaceable threaded or snap bottom cap to add a strong layer of durability and reinforcement when/if the barrel is dragged or pulled across a variety of surfaces. The barrel may have two handles built into the barrel, which will be much stronger than previously used wire handles that are difficult to use and often and quickly break. The disclosed debris barrel will be easier to use because the two or more handles allow for more than one worker to move the debris barrel. The debris barrel may have a safety orange color, which would allow the barrel to serve or act as a safety cone when flipped over. The removable/replaceable bottom cap will preserve the integrity of the barrel, so that the barrel itself will not wear out when the barrel is dragged or rolled. If the removable/replaceable bottom cap wears out, it can be easily replaced with a new bottom cap for the barrel, saving the user money on barrel replacement. The bottom cap could be used on other items, such as trash cans, buckets, etc. Due to the shape of the barrel, they can be stacked for storage and/or display. Multiple handles would allow for multiple pull or lift points and thus enable multiple users to lift and/or move the debris barrel. The round base allows the barrel to be easily rolled if being moved by a single user. The barrel may have an optional snap on base with wheels which allow the user to adapt their barrel to different projects. Given the intended safety orange color of the disclosed debris barrel, when the barrel is flipped over it may serve as an instant safety cone. Nylon handle(s) make moving the debris barrel easier, and help users of different heights comfortably work together with the barrel. An optional lid keeps debris or material dry and/or prevents it from blowing away. The overall barrel design allows for cuts and fold in the plastic that make it structurally stronger than known debris barrels. One or more sides of the top lip may be reduced in thickness to make the top edge even more flush with the surface when laid on its side, thus allowing for easier broom sweeping directly into the barrel. The disclosed debris barrel can be used for multi-purpose use.

It should be noted that the terms "first", "second", and "third", and the like may be used herein to modify elements performing similar and/or analogous functions. These modifiers do not imply a spatial, sequential, or hierarchical order to the modified elements unless specifically stated.

While the disclosure has been described with reference to several embodiments, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiments disclosed as the best mode contemplated for carrying out this disclosure, but that the disclosure will include all embodiments falling within the scope of the appended claims.

What is claimed is:

1. A debris barrel, the debris barrel comprising:

a bottom of the barrel, wherein the bottom of the barrel has a circular shape, such that the barrel can be rolled about its bottom;

a barrel wall extending from the bottom, the barrel wall and bottom forming a container;

a top of the barrel located at the top of the barrel wall, wherein the top of the barrel comprises a first side, a second side, a third side, and a fourth side, wherein the first side is parallel to the third side, the second side is parallel to the fourth side, the first side is orthogonal to the second side and fourth side, the second side is orthogonal to the third side, and the third side is orthogonal to the fourth side;

a bottom cap removeably attached to the bottom of the barrel and a portion of the barrel wall; and a handle means located near the top of the barrel, and wherein the barrel wall gradually tapers from a square shape at the top of the barrel to the circular shape at the bottom of the barrel, and the taper is at substantially the entire height of the barrel wall.

2. The debris barrel of claim 1, wherein the area enclosed by the barrel wall near the top of the barrel is larger than the area enclosed by the barrel wall near the bottom of the barrel.

3. The debris barrel of claim 1, wherein the barrel wall comprises:

a first tongue located on the barrel wall near the bottom of the barrel, the first tongue having a bottom end closer to the bottom of the barrel, and a top end closer to the top of the barrel, and wherein the bottom end of the first tongue is about flush with the outer surface of the barrel wall, and the top end of the first tongue extends out and away from the outer surface of the barrel wall;

wherein the bottom cap comprises:

a generally planar circular surface, the generally planar circular surface having an outer perimeter;

a circular opening located in the center of the generally planar circular surface;

a circular wall extending upward from the outer perimeter of the circular surface, the circular wall generally at an obtuse to right angle with the circular surface;

a first catch member extending upward from the circular wall, the first catch member comprising:

a first catch orifice, wherein the first catch orifice is configured to lock with the first tongue of the barrel wall, when the bottom cap is slid onto the bottom of the barrel.

4. The debris barrel of claim 3, wherein the barrel wall further comprises:

a second tongue located on the barrel wall near the bottom of the barrel, the second tongue having a bottom end closer to the bottom of the barrel, and a top end closer to the top of the barrel, and wherein the bottom end of the second tongue is about flush with the outer surface of the barrel wall, and the top end of the second tongue extends out and away from the outer surface of the barrel wall;

wherein the bottom cap further comprises:

a second catch member extending upward from the circular wall, the second catch member comprising:

a second catch orifice, wherein the second catch orifice is configured to lock with the second tongue of the barrel wall, when the bottom cap is slid onto the bottom of the barrel.

5. The debris barrel of claim 3, wherein the first catch member is configured to elastically deform as the first catch member slides over the first tongue until the first catch orifice locks with respect to the top end of the first tongue.

6. The debris barrel of claim 4, wherein the barrel wall further comprises:

a third tongue located on the barrel wall near the bottom of the barrel, the third tongue having a bottom end closer to the bottom of the barrel, and a top end closer to the top of the barrel, and wherein the bottom end of the third tongue is about flush with the outer surface of the barrel wall, and the top end of the third tongue extends out and away from the outer surface of the barrel wall;

a fourth tongue located on the barrel wall near the bottom of the barrel, the fourth tongue having a bottom end closer to the bottom of the barrel, and a top end closer to the top of the barrel, and wherein the bottom end of the fourth tongue is about flush with the outer surface of the barrel wall, and the top end of the fourth tongue extends out and away from the outer surface of the barrel wall;

wherein the bottom cap further comprises:

a third catch member extending upward from the circular wall, the third catch member comprising:

a third catch orifice, wherein the third catch orifice is configured to lock with the third tongue of the barrel wall, when the bottom cap is slid onto the bottom of the barrel;

a fourth catch member extending upward from the circular wall, the fourth catch member comprising:

a fourth catch orifice, wherein the fourth catch orifice is configured to lock with the fourth tongue of the barrel wall, when the bottom cap is slid onto the bottom of the barrel.

7. The debris barrel of claim 4, wherein the first catch member is configured to elastically deform as the first catch member slides over the first tongue until the first catch orifice locks with respect to the top end of the first tongue, and the second catch member is configured to elastically deform as the second catch member slides over the second tongue until the second catch orifice locks with respect to the top end of the second tongue.

8. The debris barrel of claim 6, wherein the first catch member is configured to elastically deform as the first catch member slides over the first tongue until the first catch orifice locks with respect to the top end of the first tongue, the second catch member is configured to elastically deform as the second catch member slides over the second tongue until the second catch orifice locks with respect to the top end of the second tongue, the third catch member is configured to elastically deform as the third catch member slides over the third tongue until the third catch orifice locks with respect to the top end of the third tongue, and the fourth catch member is configured to elastically deform as the fourth catch member slides over the fourth tongue until the fourth catch orifice locks with respect to the top end of the fourth tongue.

9. The debris barrel of claim 1, wherein the handle means comprises an orifice sized to fit four fingers of a hand.

10. The debris barrel of claim 9, wherein the orifice is configured to have a top portion curve back on itself to provide a greater area for the fingers to abut against when carrying the barrel.

11. The debris barrel of claim 1, wherein the handle means comprises an orifice with a loop of rope or nylon extending out from the orifice.

12. The debris barrel of claim 1, wherein the handle means comprises a first orifice adjacent to a second orifice, a rope or nylon with a first end and a second end, with the first end threaded through the first orifice, the second end threaded through the second orifice, and the rope forming a gripping area.

13. The debris barrel of claim 1, wherein the top of the barrel has a lip along the entire perimeter of the top of the barrel, and the lip has a general thickness $t_L$.

14. The debris barrel of claim 13, wherein the thickness $t_L$ is about 0.59 inches to about 0.787 inches.

15. The debris barrel of claim 13, wherein a portion of the lip along one side of the top of the barrel has a thickness of $t_N$, where $t_N$ is smaller than $t_L$.

16. The debris barrel of claim 15 wherein $t_N$ is about ½ of $t_L$.

17. The debris barrel of claim 15 wherein $t_N$ is about 0.59 inches to about 0.787 inches, and $t_L$, is about 0.98 inches to about 1.18 inches.

18. A barrel bottom cap configured to removeably attach to a bottom of a barrel and a portion of a barrel wall, the bottom cap comprising:

a generally planar circular surface, the generally planar circular surface having an outer perimeter;

a circular opening located in the center of the generally planar circular surface, the circular opening is bounded by an inner perimeter on the planar circular surface;

a circular wall extending upward from the outer perimeter of the circular surface, the circular wall generally at an obtuse to right angle with the circular surface, and no wall, lip or other structure extending upward from the circular surface at or near the inner perimeter;

a first catch member extending upward from the circular wall, the first catch member comprising:

a first catch orifice, wherein the first catch orifice is configured to lock with a first tongue member located on an outer surface of a barrel wall when the barrel bottom cap is slid onto the bottom of the barrel;

wherein the barrel bottom cap is configured to be attached to the barrel without harming the barrel or the barrel bottom cap, wherein the barrel bottom cap is further configured to be removed from the barrel without harming the barrel or the barrel bottom cap; and wherein the generally planar circular shape is configured to be parallel to and generally abut a bottom of a barrel wherein the bottom of the barrel is generally planar about its entire bottom surface.

19. The barrel bottom cap of claim 18 further comprising:

a second catch member extending upward from the circular wall, the second catch member comprising:

a second catch orifice, wherein the second catch orifice is configured to lock with a second tongue member located on an outer surface of a barrel wall when the barrel bottom cap is slid onto the bottom of the barrel;

a third catch member extending upward from the circular wall, the third catch member comprising:

a third catch orifice, wherein the third catch orifice is configured to lock with a third tongue member located on an outer surface of a barrel wall when the barrel bottom cap is slid onto the bottom of the barrel;

a fourth catch member extending upward from the circular wall, the fourth catch member comprising:

a fourth catch orifice, wherein the fourth catch orifice is configured to lock with a fourth tongue member located on an outer surface of a barrel wall when the barrel bottom cap is slid onto the bottom of the barrel.

20. The barrel bottom cap of claim 18 wherein the circular wall is configured to be flush with an outer surface of a barrel.

* * * * *